US011676553B2

(12) United States Patent
Kim et al.

(10) Patent No.: US 11,676,553 B2
(45) Date of Patent: Jun. 13, 2023

(54) REDUCED HEAT GENERATION FROM A SOURCE DRIVER OF DISPLAY DEVICE

(71) Applicant: Samsung Display Co., Ltd., Yongin-Si (KR)

(72) Inventors: Wontae Kim, Hwaseong-si (KR); Sun-Koo Kang, Seoul (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 163 days.

(21) Appl. No.: 16/449,989

(22) Filed: Jun. 24, 2019

(65) Prior Publication Data

US 2020/0051517 A1 Feb. 13, 2020

(30) Foreign Application Priority Data

Aug. 10, 2018 (KR) ..... 10-2018-0094020

(51) Int. Cl.
*G09G 3/36* (2006.01)

(52) U.S. Cl.
CPC ..... *G09G 3/3648* (2013.01); *G09G 3/3685* (2013.01); *G09G 3/3696* (2013.01); *G09G 2310/0297* (2013.01)

(58) Field of Classification Search
CPC ..... G09G 3/20; G09G 3/2007; G09G 3/2011; G09G 3/36; G09G 3/3611; G09G 3/3614; G09G 3/3648; G09G 3/3666; G09G 3/3685; G09G 3/3688; G09G 3/3696; G09G 2310/0243; G09G 2310/0289; G09G 2310/0291; G09G 2310/0297; G09G 2320/0271
See application file for complete search history.

(56) References Cited

U.S. PATENT DOCUMENTS 5,250,937 A * 10/1993 Kikuo ..... G09G 3/3696 345/89
5,640,174 A * 6/1997 Kamei ..... G09G 3/2011 345/96
5,650,796 A * 7/1997 Owaki ..... G09G 3/3696 345/94
5,774,106 A * 6/1998 Nitta ..... G09G 3/3688 345/98

(Continued)

FOREIGN PATENT DOCUMENTS

CN 101369083 A 2/2009
CN 101847379 A 9/2010

(Continued)

*Primary Examiner* — Keith L Crawley
(74) *Attorney, Agent, or Firm* — Cantor Colburn LLP

(57) ABSTRACT

A display device includes a display panel including first data lines, second data lines, gate lines, and a plurality of pixels, a voltage generator which generates a first driving voltage and a second driving voltage, and a source driver which generates a first data voltage having a first polarity based on the first driving voltage and a second data voltage having a second polarity based on the second driving voltage. The source driver includes a first source driver coupled to the first data lines and a second source driver coupled to the second data lines. The voltage generator alternately provides the first driving voltage and the second driving voltage to each of the first source driver and the second source driver.

7 Claims, 11 Drawing Sheets

(56) References Cited

U.S. PATENT DOCUMENTS

| | | | | |
|---|---|---|---|---|
| 6,249,270 | B1 * | 6/2001 | Ito | G09G 3/3688 345/100 |
| 2007/0164941 | A1 | 7/2007 | Park et al. | |
| 2008/0136761 | A1 * | 6/2008 | Hong | G09G 3/2022 345/89 |
| 2009/0033590 | A1 * | 2/2009 | Feng | G09G 3/3614 345/58 |
| 2009/0040244 | A1 * | 2/2009 | Lee | G09G 3/3696 345/89 |
| 2010/0245336 | A1 | 9/2010 | Zhang | |
| 2011/0279484 | A1 | 11/2011 | Han et al. | |
| 2015/0145898 | A1 * | 5/2015 | Hwang | G09G 3/3614 345/690 |
| 2018/0197485 | A1 | 7/2018 | Jose et al. | |

FOREIGN PATENT DOCUMENTS

| | | | |
|---|---|---|---|
| JP | 08305323 | A | 11/1996 |
| KR | 1020100110608 | A | 10/2010 |
| KR | 101782641 | B1 | 6/2012 |
| KR | 1020170088471 | A | 8/2017 |

* cited by examiner

REDUCED HEAT GENERATION FROM A SOURCE DRIVER OF DISPLAY DEVICE

This application claims priority to Korean Patent Application No. 10-2018-0094020, filed on Aug. 10, 2018, and all the benefits accruing therefrom under 35 U.S.C. § 119, the content of which in its entirety is herein incorporated by reference.

BACKGROUND

1. Field

Exemplary embodiments relate generally to a display device.

2. Description of the Related Art

A liquid crystal display ("LCD") device typically includes a lower substrate, an upper substrate, and a liquid crystal layer between the lower substrate and the upper substrate.

The lower substrate may include a first base substrate, a gate line and a data line on the first base substrate, a switching element electrically coupled to the gate line and the data line, and a pixel electrode electrically coupled to the switching element. The upper substrate may include a second base substrate opposite to the first base substrate, a color filter on the second base substrate, and a common electrode on the color filter.

The liquid crystal layer may include liquid crystal molecules, an arrangement of which is changed according to an electric field generated by a pixel voltage applied to the pixel electrode and a common voltage applied to the common electrode.

SUMMARY

A liquid crystal display ("LCD") device may be driven using an inversion driving method that changes a direction of the arrangement of the liquid crystal molecules by changing a polarity of a data voltage provided to a display panel of the LCD device. Load of a source driver may increase as a size and a resolution of the LCD device increases. Thus, a heat problem of the source driver that provides the data voltage to the display panel may occur.

Some exemplary embodiments provide a display device in which heat generated from a source driver is substantially reduced.

According to an exemplary embodiment, a display device includes a display panel including first data lines, second data lines, gate lines, and a plurality of pixels, a voltage generator which generates a first driving voltage and a second driving voltage, and a source driver which generates a first data voltage having a first polarity based on the first driving voltage and a second data voltage having a second polarity based on the second driving voltage. In such an embodiment, the source driver includes a first source driver coupled to the first data lines and a second source driver coupled to the second data lines, and the voltage generator alternately provides the first driving voltage and the second driving voltage to each of the first source driver and the second source driver.

In an exemplary embodiment, the voltage generator may alternately provide the first driving voltage and the second driving voltage to each of the first source driver and the second source driver on a frame-by-frame basis.

In an exemplary embodiment, the voltage generator may provide the first driving voltage to the first source driver and provides the second driving voltage to the second source driver in an N-th frame, where the N is an integer greater than zero (0), and the voltage generator may provide the second driving voltage to the first source driver and provides the first driving voltage to the second source driver in an (N+1)-th frame.

In an exemplary embodiment, the first source driver may generate the first data voltage having the first polarity based on the first driving voltage and the second source driver may generate the second data voltage having the second polarity based on the second driving voltage in the N-th frame. In such an embodiment, the first source driver may generate the second data voltage having the second polarity based on the second driving voltage and the second source driver may generate the first data voltage having the first polarity based on the first driving voltage in the (N+1)-th frame.

In an exemplary embodiment, the first driving voltage may include a first analog driving voltage and a second analog driving voltage having a voltage level lower than a voltage level of the first analog driving voltage, and the second driving voltage may include the second analog driving voltage and a ground voltage.

In an exemplary embodiment, the first data voltage may have a voltage level changed between the voltage level of the first analog driving voltage and the voltage level of the second analog voltage, and the second data voltage may have the voltage level changed between the voltage level of the second analog driving voltage and the ground voltage.

In an exemplary embodiment, when the voltage generator provides the first driving voltage, the voltage generator may further provide a bias voltage having a voltage level the same as the voltage level of the second analog driving voltage to provide a logic signal. In such an embodiment, when the voltage generator provides the second driving voltage, the voltage generator may further provide a bias voltage having a voltage level the same as the voltage level of the ground voltage to provide the logic signal.

In an exemplary embodiment, the first data lines may be coupled to an odd-numbered pixel groups including pixels arranged in a line, and the second data lines may be coupled to an even-numbered pixel groups including pixels arranged in a line.

In an exemplary embodiment, each of the first and second source drivers may be implemented as a chip-on-film form including an integrated circuit and a flexible printed circuit board on which the integrated circuit is disposed.

According to another exemplary embodiment, a display device includes a display panel including first data lines, second data lines, gate lines, a plurality of pixels, and a multiplexer coupled to the first data lines and the second data lines, a voltage generator which generates a first driving voltage and a second driving voltage, a first source driver which generates a first data voltage having a first polarity based on the first driving voltage, and a second source driver which generates a second data voltage having a second polarity based on the second driving voltage. In such an embodiment, the multiplexer couples the first source driver alternately to the first data liens and the second data lines, and couples the second source driver alternately to the first data lines and the second data lines.

In an exemplary embodiment, the voltage generator may provide the first driving voltage to the first source driver and provides the second driving voltage to the second source driver.

In an exemplary embodiment, the multiplexer may selectively couple the first data lines to the first source driver or the second source driver and selectively couple the second data lines and the first source driver or the second source driver.

In an exemplary embodiment, the multiplexer may couple the first data lines alternately to the first source driver and the second source driver and couple the second data lines alternately to the first source driver and the second source driver on a frame-by-frame basis.

In an exemplary embodiment, the multiplexer may couple the first data lines to the first source driver, provide the first data voltage to the first data lines, couple the second data lines to the second source driver, and provide the second data voltage to the second data lines in an N-th frame, where N is an integer greater than zero (0). In such an embodiment, the multiplexer may couple the first data lines to the second source driver, provide the second data voltage to the first data lines, couple the second data liens to the first source driver, and provide the first data voltage to the second data lines in an (N+1)-th frame.

In an exemplary embodiment, the first driving voltage may include a first analog driving voltage and a second analog driving voltage having a voltage level lower than a voltage level of the first analog driving voltage, and the second driving voltage may include the second analog driving voltage and a ground voltage.

In an exemplary embodiment, the first data voltage may have a voltage level changed between the voltage level of the first analog driving voltage and the voltage level of the second analog driving voltage, and the second data voltage may have a voltage level changed between the voltage level of the second analog driving voltage and the ground voltage.

In an exemplary embodiment, the voltage generator may further provide a bias voltage having the same as the voltage level of the second analog driving voltage to the first source driver to provide a logic signal, and may further provide a bias voltage having the voltage level the same as the voltage level of the ground voltage to the second source driver.

In an exemplary embodiment, the first data lines may be coupled to an odd-numbered pixel groups including the pixels arranged in a line, and the second data lines may be coupled to an even-numbered pixel groups including pixels arranged in a line.

In an exemplary embodiment, each of the first and second source drivers may be implemented as a chip-on-film form including an integrated circuit and a flexible printed circuit board, on which the integrated circuit is disposed.

In an exemplary embodiment, the flexible printed circuit board of the first source driver and the flexible printed circuit board of the second source driver may partially overlap each other.

In exemplary embodiments of the invention, the display device may alternately provide the first data voltage having the first polarity and the second data voltage having the second polarity to the first data lines and the second data lines by using the first source driver coupled to the first data lines and the second source driver coupled to the second data lines and by alternately providing the first driving voltage and the second driving voltage to the first source driver and the second driver. Thus, loads of the first source driver and the second source driver may decrease, and sizes of integrated circuits included in the first source driver and the second source driver may decrease. Accordingly, in such embodiments, heat generated from the source driver may be substantially reduced as the size of the integrated circuit decreases.

In such embodiments, the display device may alternately provide the first data voltage having the first polarity and the second data voltage having the second polarity to the first data lines and the second data lines by using the first source driver that generates the first data voltage having the first polarity, the second source driver that generates the second data voltage having the second polarity, and the multiplexer that alternately couple the first source driver and the second source driver to the first data lines and the second data lines. Thus, the loads of the first source driver and the second source driver may decrease, and sizes of integrated circuits included in the first source driver and the second source driver may decrease. Accordingly, in such embodiments, the heat generated from the source driver may be substantially reduced as the size of the integrated circuit decreases.

BRIEF DESCRIPTION OF THE DRAWINGS

The above and other features of the invention will become more apparent by describing in detailed exemplary embodiments thereof with reference to the accompanying drawings, in which.

DETAILED DESCRIPTION

Figure 1:
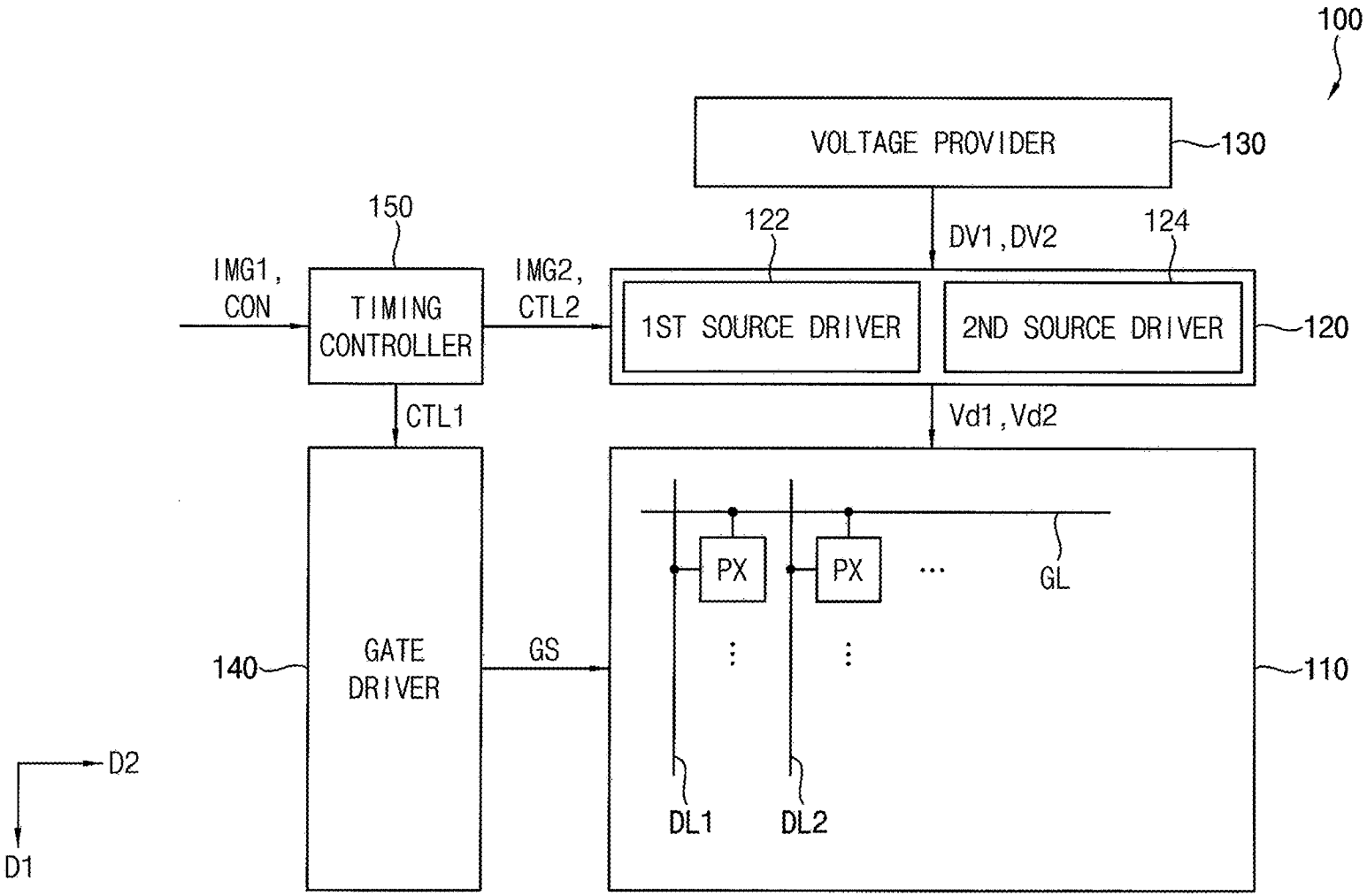
FIG. 1 is a block diagram illustrating a display device according to an exemplary embodiment.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "connected to" another element, it can be directly connected to the other element or intervening elements may be present therebetween. In contrast, when an element is referred to as being "directly connected to" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. "At least one of A and B" means "A or B." It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Hereinafter, exemplary embodiments of the invention will be described in detail with reference to the accompanying drawings.

FIG. 1 is a block diagram illustrating a display device according to an exemplary embodiment.

Referring to FIG. 1, an exemplary embodiment of a display device 100 may include a display panel 110, a voltage generator 130, and a source driver 120. In such an embodiment, the display device 100 may include a gate driver 140 and a timing controller 150.

The display panel 110 may include first data lines DL1, second data lines DL2, gate lines GL, and a plurality of pixels PX. The first data lines DL1 and the second data lines DL2 may extend in a first direction D1 and be arranged in a second direction D2 perpendicular to the first direction D1. In one exemplary embodiment, for example, the first data lines DL1 and the second data lines DL2 may be alternately arranged with each other.

The gate lines GL may extend in the second direction D2 and be arranged in the first direction D1. In one exemplary embodiment, for example, the first direction D1 may be a direction parallel to a short side of the display panel 110, and the second direction D2 may be a direction parallel to a long side of the display panel 110. In one exemplary embodiment, for example, each of the pixels PX may be defined in intersection regions of the first data lines DL1 and the gate lines GL and in intersection regions of the second data lines DL2 and the gate lines GL. In one exemplary embodiment, for example, the first data lines DL1 may be coupled to odd-numbered pixel groups including the pixels PX arranged in a line and the second data lines DL2 may be coupled to even-numbered pixel groups including the pixels PX arranged in the line. The odd-numbered pixel group and the even-numbered pixel group may be alternately arranged with each other in the second direction D2. Each of the pixels PX may include a thin film transistor electrically coupled to the gate line GL and the first data line DL1 (or, to the gate line GL and the second data line DL2), liquid crystal capacitor and a storage capacitor coupled to the thin film transistor. In such an embodiment, the display panel 110 may be a liquid crystal display panel, and the display device 100 may be a liquid crystal display device. The liquid crystal display panel may display an image using light provided form a backlight unit.

The voltage generator 130 may generate a first driving voltage DV1 and a second driving voltage DV2. The first driving voltage DV1 may include a first analog driving voltage and a second analog driving voltage, the voltage level of which is lower than that of the first analog driving voltage. In one exemplary embodiment, for example, the voltage level of the second analog voltage may be a half of the voltage level of the first analog driving voltage. In one exemplary embodiment, for example, the voltage level of the first analog driving voltage may be about 8 volts (V), and the voltage level of the second analog driving voltage may be about 4 V. The voltage level of the second analog driving voltage may be greater than, less than, or the same as a voltage level of a common voltage VCOM (shown in FIGS. 5A to 5C) provided to a common electrode of the display panel 110 because the voltage level of the common voltage is changed according to a property (e.g., a kickback voltage) of the display panel 110. The second driving voltage DV2 may include the second analog driving voltage and a ground voltage. In one exemplary embodiment, for example, the ground voltage may be 0 V. The voltage generator 130 may provide the first driving voltage DV1 and the second driving voltage DV2 to the source driver 120.

The source driver 120 may generate a first data voltage Vd1 having a first polarity based on the first driving voltage DV1 and a second data voltage Vd2 having a second polarity based on the second driving voltage DV2. The first data voltage Vd1 having the first polarity may be a positive polarity voltage. The second data voltage Vd2 having the second polarity may be a negative polarity voltage. The first data voltage Vd1 may have a voltage level changed between the voltage level of the first analog driving voltage and the voltage level of the second analog driving voltage. The second data voltage Vd2 may have a voltage level changed between the voltage level of the second analog driving voltage and the ground voltage. The source driver 120 may include a first source driver 122 and a second source driver 124. The first source driver 122 may be coupled to the first data lines DL1 and the second source driver 124 may be coupled to the second data line DL2. In one exemplary embodiment, for example, the first source driver 122 may provide the data voltage to the odd-numbered pixel group coupled to the first data line DL1 through the first data line DL1 and provide the data voltage to the even-numbered pixel group coupled to the second data line DL2 through the second data line DL2.

The voltage generator 130 may alternately provide the first driving voltage DV1 and the second driving voltage DV2 to each of the first source driver 122 and the second source driver 124. In one exemplary embodiment, for example, the voltage generator 130 may alternatively provide the first driving voltage DV1 and the second driving voltage DV2 to each of the first source driver 122 and the second source driver 124 on a frame-by-frame basis. The voltage generator 130 may provide the first driving voltage DV1 to the first source driver 122 and provide the second driving voltage DV2 to the second source driver 124 in an N-th frame, where N is an integer greater than 0. The voltage generator 130 may provide the second driving voltage DV2 to the first source driver 122 and provide the first driving voltage DV1 to the second source driver 124.

Each of the first source driver 122 and the second source driver 124 may alternately generate the first data voltage Vd1 having the first polarity and the second data voltage having the second polarity based on the first driving voltage DV1 and the second driving voltage DV2. In one exemplary embodiment, for example, each of the first source driver 122 and the second source driver 124 may generate the first data voltage Vd1 and the second data voltage Vd2 on a frame-by-frame basis. The first source driver 122 may generate the first data voltage Vd1 based on the first driving voltage DV1 and second source driver 124 may generate the second data voltage Vd2 based on the second driving voltage DV2 in the N-th frame. The first source driver 122 may generate the second data voltage Vd2 based on the second driving voltage DV2 and second source driver 124 may generate the first data voltage Vd1 based on the first driving voltage DV1 in the (N+1)-th frame. Here, the first data voltage Vd1 and the second data voltage Vd2 may have the voltage level corresponding to a second image data IMG2 provided from the timing controller 150. The first source driver 122 and the second source driver 124 may output the first data voltage Vd1 or the second data voltage Vd2 based on a second control signal CTL2 provided from the timing controller 150. In an exemplary embodiment, as described, the first source driver 122 may alternately receive the first driving voltage DV1 and the second driving voltage DV2 from the voltage generator 130 on a frame-by-frame basis, alternately generate the first data voltage Vd1 and the second data voltage Vd2 every frame, and alternately provide the first data voltage Vd1 and the second data voltage Vd2 to the first data line DL1 every frame. In such an embodiment, the second source driver 124 may alternately receive the second driving voltage DV2 and the first driving voltage DV1 from the voltage generator 130 every frame, alternately generate the second data voltage Vd2 and the first data voltage Vd1 every frame, and alternately provide the second data voltage Vd2 and the first data voltage Vd1 to the second data line DL2 every frame. Each of the first source driver 122 and the second source driver 124 may be implemented as a chip-on-film ("COF") form that includes an integrated circuit ("IC") and a flexible printed circuit board on which the IC is disposed. In such an embodiment, load of the first source driver 122 and the second source driver 124 may decrease by generating the first data voltage Vd1 having the first polarity (e.g., the positive data voltage) and the second data voltage Vd2 having the second polarity (e.g., the negative data voltage, such that heat problem of the IC of the source driver 120 may be effectively prevented.

The gate driver 140 may generate a gate signal GS to be provided to the pixel PX. The gate driver 140 may generate the gate signal GS based on a first control signal CTL1 provided from the timing controller 150, and sequentially provide the gate signal GS to the gate lines GL in the display panel 110. In an exemplary embodiment, the gate driver 140 may be disposed, e.g., mounted, on the display panel 110 as amorphous silicon thin film transistor ("TFT") gate driver circuit ("ASG") or oxide silicon TFT gate driver circuit ("OSG") which may be simultaneously formed with transistors of the pixels PX. Alternatively, the gate driver 140 may be formed as a plurality of driving chips and be mounted on a non-display area of the display panel 110 as chip-on-glass ("COG"). Alternatively, the gate driver 140 may be formed as the plurality of driving chips, be mounted on a flexible printed circuit board as Chip-on-film ("COF"), and be coupled to the display panel 110.

The timing controller 150 may generate control signals CTL1, CTL2 that control the gate driver 140 and the source driver 120. The timing controller 150 may receive a control signal CON from an external device. The timing controller 150 may generate the first control signal CTL1 to be provided to the gate driver 140 based on the control signal CON. In one exemplary embodiment, for example, the first control signal CTL1 may include a vertical start signal and a gate clock signal. The timing controller 150 may generate the second control signal CTL2 to be provided to the source driver 120 based on the control signal CON. In one exemplary embodiment, for example, the second control signal CTL2 may include a horizontal start signal and a data clock signal. In an exemplary embodiment, the timing controller 150 may convert a first image data IMG1 provided from the external device to the second image data IMG2. In one exemplary embodiment, for example, the timing controller 150 may convert the first image data IMG1 to the second image data IMG2 based on an algorithm that compensates display quality of the first image data IMG1. The timing controller 150 may provide the first control signal CTL1 to the gate driver 140 and provide the second control signal CTL2 and the second image data IMG2 to the source driver 120.

The second image data IMG2 may be provided to the first source driver 122 and the second source driver 124 as a logic signal. The logic signal may be provided to the first source driver 122 and the second source driver 124 from the timing controller 150 using alternating-current ("AC") coupling. The voltage generator 130 may provide bias voltages for the AC coupling to each of the first source driver 122 and the second source driver 124. When the voltage generator 130 provides the first driving voltage DV1 to the first source driver 122 or the second source driver 124, the voltage generator 130 may further provide the bias voltage having a voltage level the same as the second analog driving voltage. When the voltage generator 130 provides the second driving voltage DV2 to the first source driver 122 or the second source driver 124, the voltage generator may further provide the bias voltage having a voltage level the same as the ground voltage.

In an exemplary embodiment, as described above, the display device 100 may decrease the load of the first source driver 122 and the second source driver 124 by including the first source driver 122 coupled to the first data lines DL1 and the second source driver 124 coupled to the second data lines DL2 and alternately providing the first data voltage Vd1 having the first polarity and the second data voltage Vd2 having the second polarity to each of the first source driver 122 and the second source driver 124. Thus, the heat problem of the first source driver 122 and the second source driver 124 may be effectively prevented.

Figure 2:
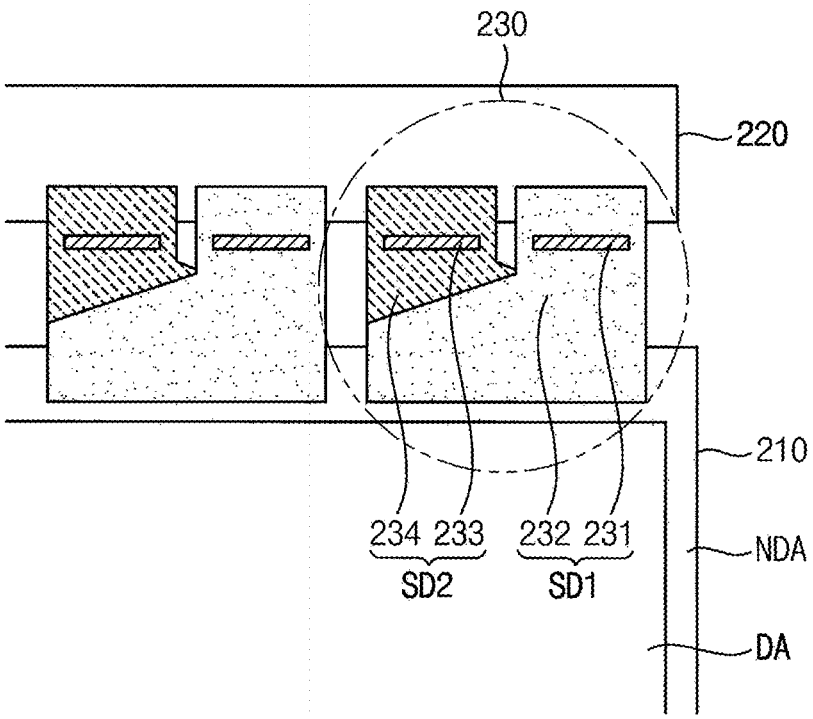
FIG. 2 is a diagram illustrating a part of the display device of FIG. 1.
Figure 3:
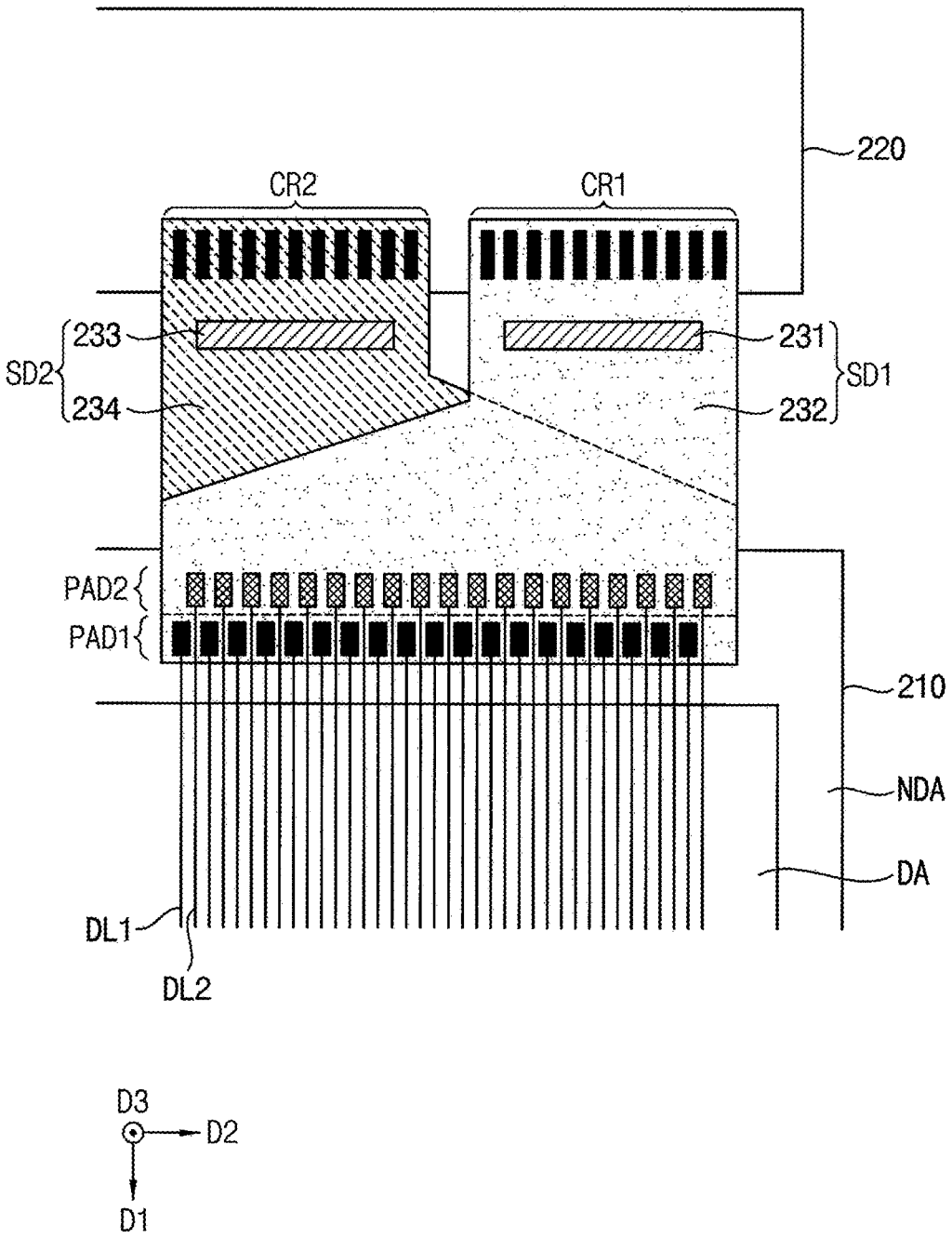
FIG. 3 is a diagram illustrating an exemplary embodiment of a source driver included in the display device of FIG. 1.

FIG. 2 is a diagram illustrating a part of the display device of FIG. 1. FIG. 3 is a diagram illustrating an exemplary embodiment of a source driver included in the display device of FIG. 1.

Referring to FIG. 2, the source driver 230 may include the first source driver SD1 and the second source driver SD2. Each of the first source driver SD1 and the second source driver SD2 may be implemented as the COF form that includes an IC 231 or 233 and a flexible printed circuit board 232 or 234 on which the IC 23 or 233 is mounted and be coupled to the display panel 210 and a printed circuit board ("PCB") 220.

Referring to FIGS. 2 and 3, the display panel 210 may include a display area DA and the non-display area NDA. The plurality of data lines DL1, DL2 may be disposed in the display area DA. A pad unit PAD1, PAD2 coupled to the data lines DL1, DL2 may be disposed in the non-display area NDA. In an exemplary embodiment, the pad unit PAD1, PAD2 may include a first pad unit PAD1 and a second pad unit PAD2. Pads of the first pad unit PAD1 may be arranged in the second direction D2 and be coupled to the first data lines DL1. Pads of the second pad unit PAD2 may be arranged in the second direction D2 and be coupled to the second data lines DL2. The first pad unit PAD1 may be parallel with the second pad unit PAD2 in the first direction D1. In one exemplary embodiment, for example, the first data lines DL1 may be coupled to the odd-numbered pixel groups and the second data liens DL2 may be coupled to the even-numbered pixel groups. The first pad unit PAD1 may be coupled to the first source driver SD1 and the second pad unit PAD2 may be coupled to the second source driver SD2.

The PCB 220 may include the timing controller 150, the voltage generator 130, etc. implemented as a driving chip. In one exemplary embodiment, for example, the timing controller 150 may generate the second image data IMG2 and the second control signal CTL2, and the voltage generator may generate the first driving voltage DV1 and the second driving voltage DV2. The PCB 220 may include a first connection region CR1 and a second connection region CR2. The first connection region CR1 may be coupled to the first source driver SD1 and the second connection region CR2 may be coupled to the second source driver SD2. The second image data IMG2, the second control signal CTL2, the first driving voltage DV1, and the second driving voltage DV2, which are generated in the timing controller 150 and in the voltage generator 130, may be provided to the first source driver SD1 and the second source driver SD2 through the first connection region CR1 and the second connection region CR2 of the PCB 220. Here, the voltage generator may be coupled to the first source driver SD1 and the second source driver SD2 through different layers or different lines of the PCB 220. Thus, the voltage generator may provide different voltages (i.e., the first driving voltage DV1 and the second driving voltage DV2) to the first source driver SD1 and the second source driver SD2.

The first source driver SD1 may include a first IC 231 and a first flexible printed circuit board 232. The first IC 231 may be mounted on the first flexible printed circuit board 232. The first flexible printed circuit board 232 of the first source driver SD1 may be coupled between the first connection region CR1 of the PCB 220 and the first pad unit PAD1 of the display panel 210.

The second source driver SD2 may include a second IC 233 and a second flexible printed circuit board 234. The second IC 233 may be mounted on the second flexible printed circuit board 234. The second flexible printed circuit board 234 of the second source driver SD2 may be coupled between the second connection region CR2 of the PCB 220 and the second pad unit PAD2 of the display panel 210.

The first flexible printed circuit board 232 of the first source driver SD1 and the second flexible printed circuit board 234 of the second source driver SD2 may be partially overlap each other when viewed from a plan view in a third direction D3 as shown in FIG. 3. Here, a size of the second flexible printed circuit board 234 of the second source driver SD2 may be small than a size of the first flexible printed circuit board 232 of the first source driver SD1.

The first source driver SD1 may generate the first data voltage Vd1 corresponding to the second image data IMG2 based on the first driving voltage DV1 and the second control signal CTL2 when the voltage generator 130 provides the first driving voltage DV1 to the first source driver SD1. Here, the first data voltage DV1 may have the first polarity. The first source driver SD1 may generate the second data voltage Vd2 corresponding to the second image data IMG2 based on the second driving voltage DV2 and the second control signal CTL2 when the voltage generator provides the second driving voltage DV2 to the first source driver SD1. Here, the second data voltage DV2 may have the second polarity.

The second source driver SD2 may generate the first data voltage Vd1 corresponding to the second image data IMG2 based on the first driving voltage DV1 and the second control signal CTL2 when the voltage generator 130 provides the first driving voltage DV1 to the second source driver SD2. Here, the first data voltage DV1 may have the first polarity. The second source driver SD2 may generate the second data voltage Vd2 corresponding to the second image data IMG2 based on the second driving voltage DV2 and the second control signal CTL2 when the voltage generator 130 provides the second driving voltage DV2 to the second source driver SD2. Here, the second data voltage DV2 may have the second polarity.

In an exemplary embodiment, the first data voltage DV1 having the first polarity and the second data voltage DV2 having the second polarity may be alternately provided to each of the first data lines DL1 and the second data lines DL2 because the first driving voltage Vd1 and the second driving voltage Vd2 are alternately provide to each of the first source driver SD1 and the second source driver SD2. In such an embodiment, the data voltage having different polarities may be provided to the first data lines DL1 and the second data lines DL2 because the first data lines DL1 are coupled to the first source driver SD1 and the second data liens DL2 are coupled to the second source driver SD2.

A size of the IC included in each of the first source driver SD1 and the second source driver SD2 may decrease because the load of each of the first source driver SD1 and the second source driver SD2 included in the source driver 230 is less than load of a conventional source driver. Thus, the heat of the IC may decrease.

Figure 4:
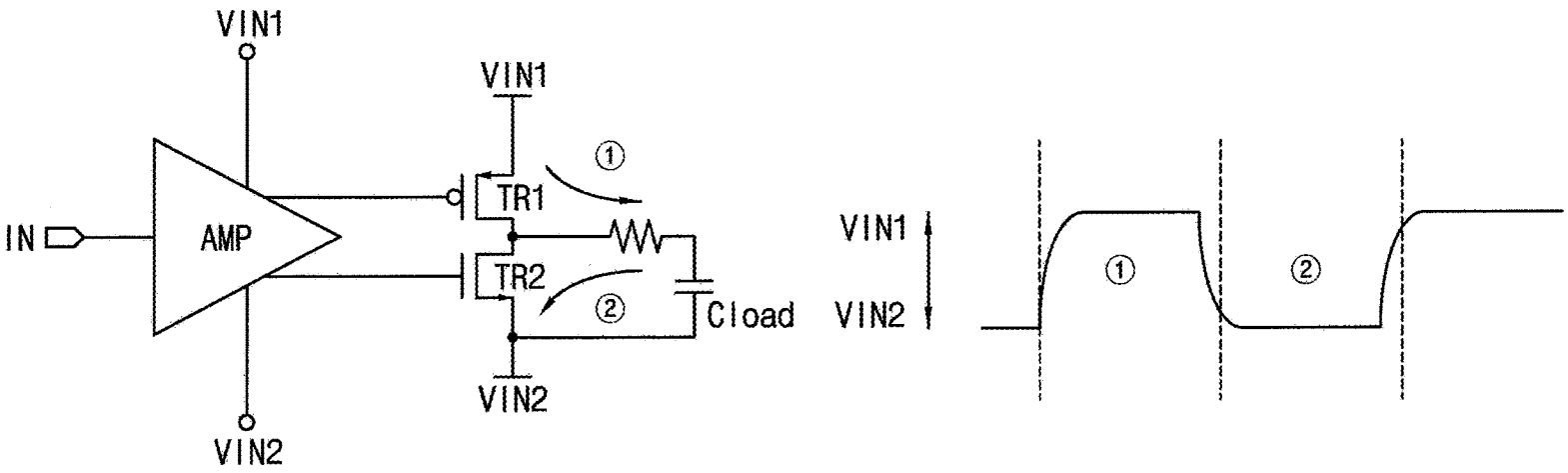
FIG. 4 is a circuit diagram illustrating an exemplary embodiment of a driving buffer of the source driver of FIG. 3.
Figure 5A:
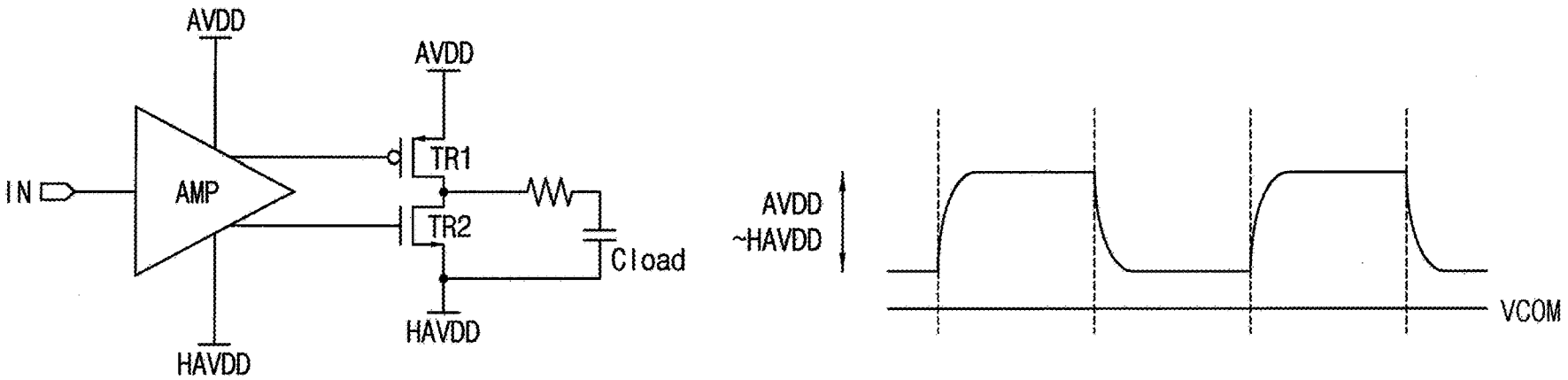
FIGS. 5A through 5C are diagrams illustrating an operation of an exemplary embodiment of the driving buffer of FIG. 4.
Figure 5B:
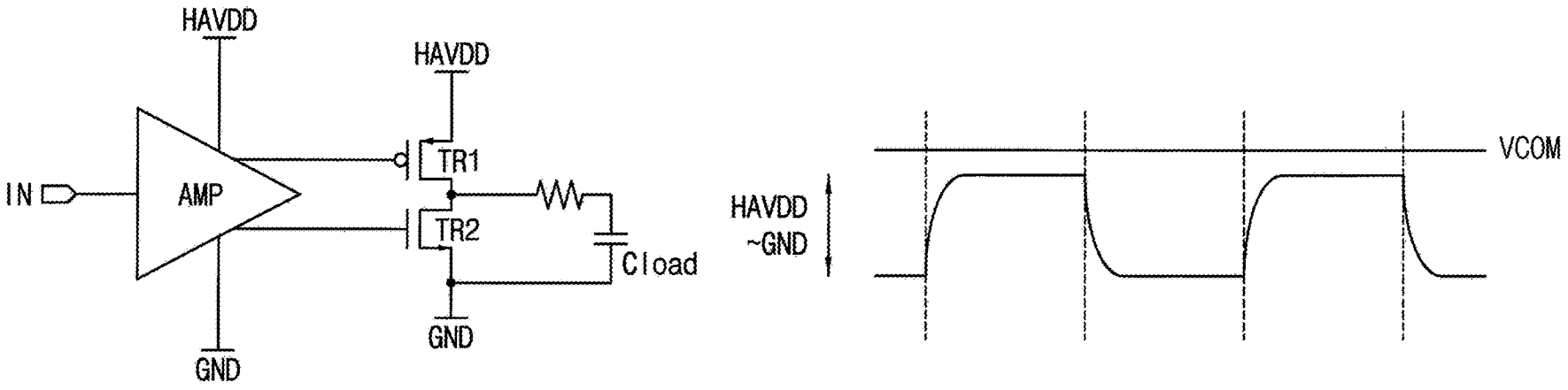
Figure 5C:
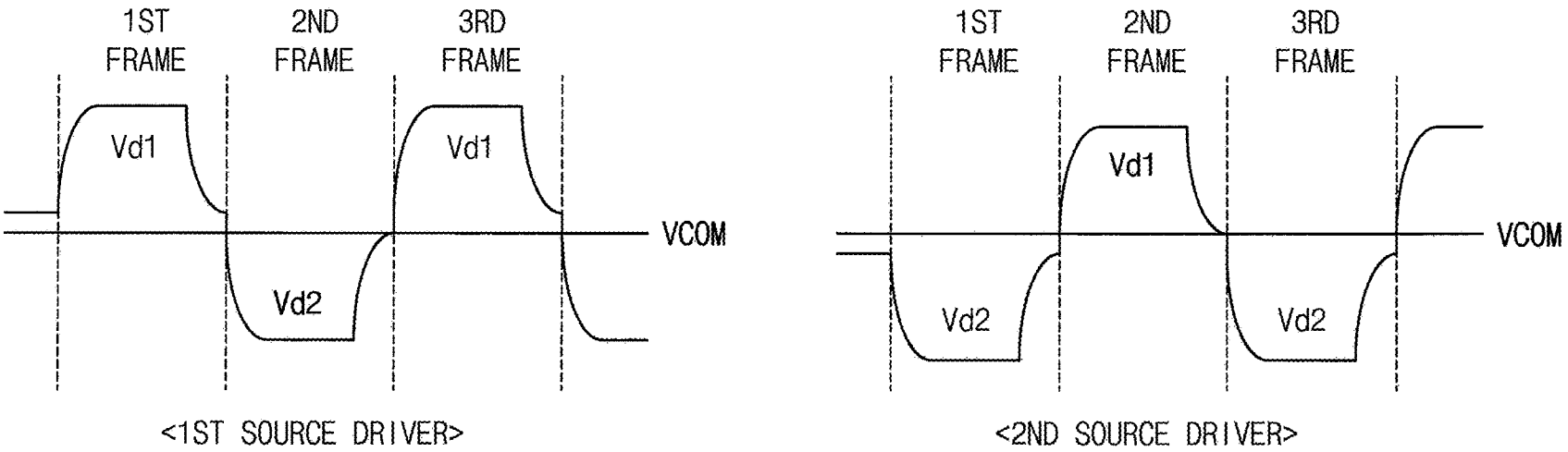

FIG. 4 is a circuit diagram illustrating an exemplary embodiment of a driving buffer of the source driver of FIG. 3. FIGS. 5A through 5C are diagrams illustrating an operation of an exemplary embodiment of the driving buffer of FIG. 4.

The source driver may include a shift register, a latch, a level shifter, a digital-analog converter ("DAC"), and a driving buffer. The shift register may sequentially write a digital image data to the latch. The digital image data stored in the latch may be output to the level shifter. The level shifter may change a voltage level of the digital image data and output the digital image data having a changed voltage level to the DAC. The DAC may receive the digital image data, convert the digital image data to an analog image data, and output the analog image data to the driving buffer.

Referring to FIG. 4, the driving buffer may include an operational amplifier AMP and transistors TR1, TR2. The operational amplifier AMP may receive a first input voltage VIN1 and a second input voltage VIN2. The operational amplifier AMP may amplify the image data provided through an input terminal IN thereof to have a voltage level between the voltage level of the first input voltage VIN1 and the voltage level of the second input voltage VIN2. When the first transistor TR1 is turned on based on an output voltage of the operational amplifier AMP, electrons may be charged in a load capacitor Cload (①). When the second transistor TR2 is turned on based on the output voltage of the operational amplifier AMP, the electrons stored in the load capacitor Cload may be discharged (②). As shown in FIG. 4, the driving buffer may output a voltage having the voltage level between the voltage level of the first input voltage VIN1 and the voltage level of the second input voltage VIN2.

Referring to FIG. 5A, the first driving voltage DV1 that includes the first analog driving voltage AVDD and the second analog driving voltage HAVDD may be provided to the driving buffer of the first source driver SD1 or the driving buffer of the second source driver SD2. When the first driving voltage DV1 is provided to the first source driver SD1 or the second source driver SD2, the first analog driving voltage AVDD may be provided to the operational amplifier AMP as the first input voltage VIN1 and the second analog driving voltage HAVDD may be provided to the operational amplifier AMP as the second input voltage VIN2. When the first transistor TR1 is turned on based on the output voltage of the operational amplifier AMP, the electrons may be charged in the load capacitor Cload. When the second transistor TR2 is turned on based on the output voltage of the operational amplifier AMP, the electrons charged in the load capacitor Cload may be discharged. Thus, the driving buffer may generate the first data voltage Vd1 having the first polarity that swings between the first analog driving voltage AVDD and the second analog driving voltage HAVDD.

Referring to FIG. 5B, the second driving voltage DV2 that includes the second analog driving voltage HAVDD and the ground voltage GND may be provided to the driving buffer of the first source driver SD1 or the driving buffer of the second source driver SD2. When the second driving voltage DV2 is provided to the first source driver SD1 or the second source driver SD2, the second analog driving voltage HAVDD may be provided to the operational amplifier AMP as the first input voltage VIN1 and the ground voltage may be provided to the operational amplifier AMP as the second input voltage VIN2. When the first transistor TR1 is turned on based on the output voltage of the operational amplifier AMP, the electrons may be charged in the load capacitor Cload. When the second transistor TR2 is turned on based on the output voltage of the operational amplifier AMP, the electrons charged in the load capacitor Cload may be discharged. Thus, the driving buffer may generate the second data voltage Vd2 having the second polarity that swings between the second analog driving voltage HAVDD and the ground voltage GND as shown in FIG. 5B.

The voltage generator may alternately provide the first driving voltage DV1 and the second driving voltage DV2 to each of the first source driver SD1 and the second source driver SD2 on a frame-by-frame basis. Referring to FIG. 5C, the first source driver SD1 (referred to as "1ST SOURCE DRIVER" in FIG. 5C) may generate the first data voltage Vd1 having the first polarity based on the first driving voltage DV1 in a first frame 1ST FRAME, generate the second data voltage Vd2 having the second polarity based on the second driving voltage DV2 in a second frame 2ND FRAME, and generate the first data voltage Vd1 having the first polarity based on the first driving voltage DV1 in a third frame 3RD FRAME. The second source driver SD2 (referred to as "2ND SOURCE DRIVER" in FIG. 5C) may generate the second data voltage Vd2 having the second polarity based on the second driving voltage DV2 in the first frame 1ST FRAME, generate the first data voltage Vd1 having the first polarity based on the first driving voltage DV1 in the second frame 2ND FRAME, and generate the second data voltage Vd2 having the second polarity based on the second driving voltage DV2 in the third frame 3RD FRAME.

Figure 6:
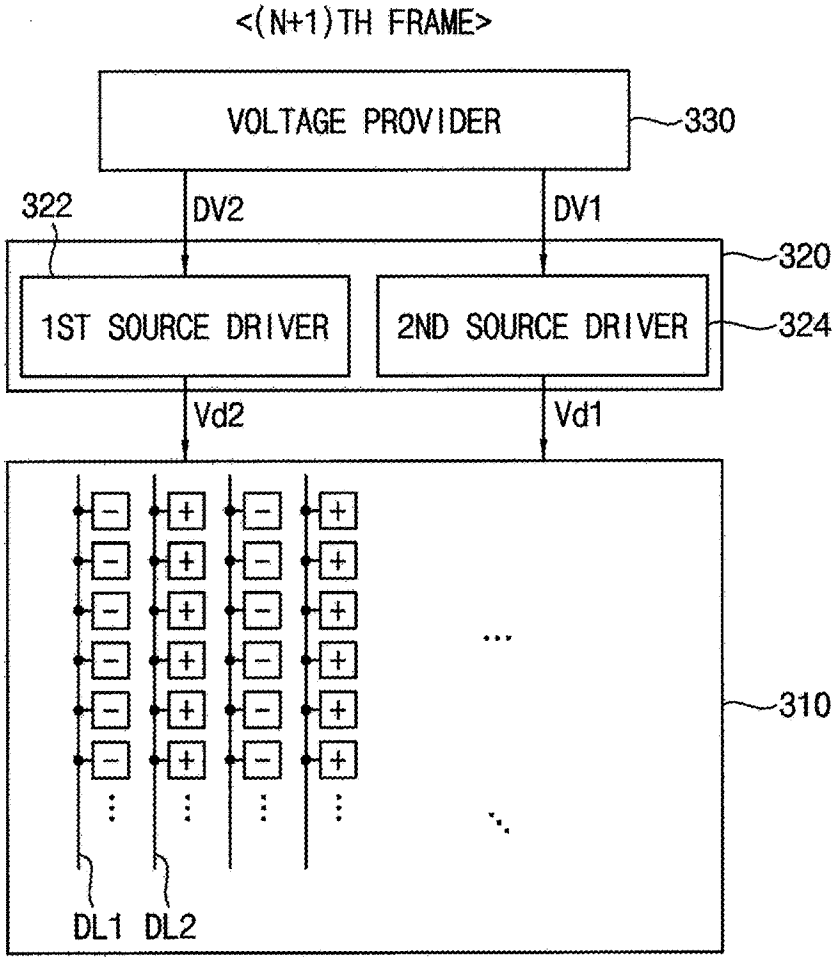
FIG. 6 is a diagram illustrating an operation of the display device of FIG. 1.
Figure 6:
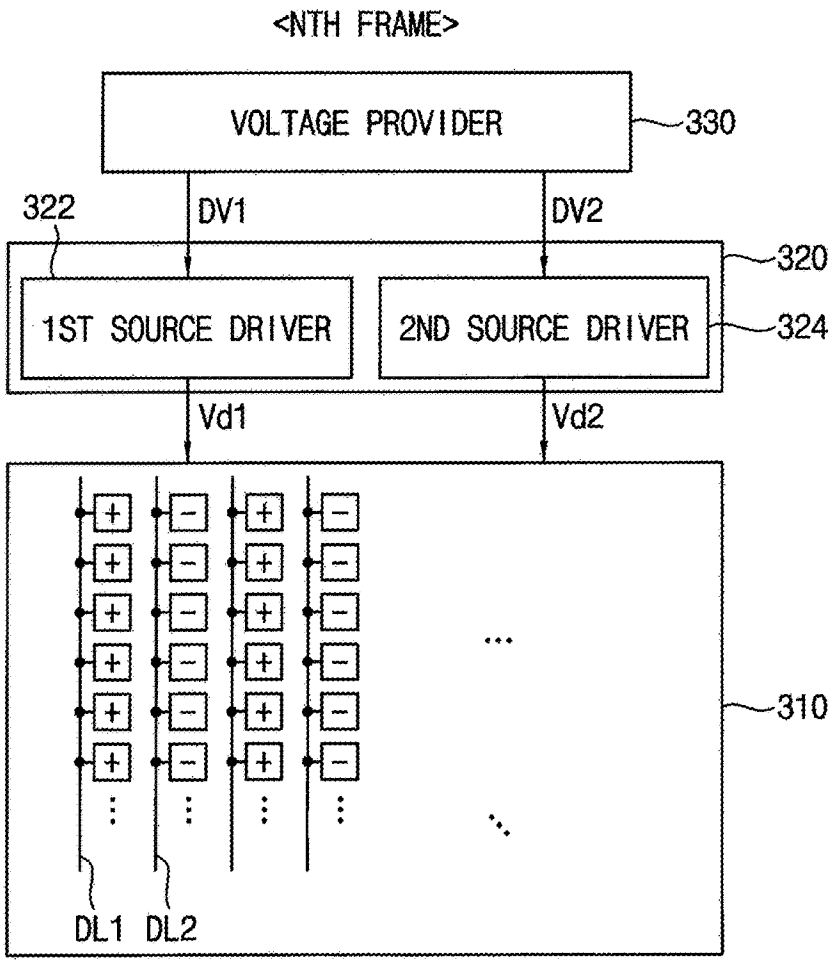

FIG. 6 is a diagram illustrating an operation of the display device of FIG. 1.

Referring to FIG. 6, the voltage generator 330 may provide the first driving voltage DV1 to the first source driver 322 of the source driver 320 and provide the second driving voltage DV2 to the second source driver 324 of the source driver 320 in an N-th frame NTH FRAME. The first source driver 322 may generate the first data voltage Vd1 having the first polarity (+) (e.g., a voltage having the voltage level between the first analog driving voltage and the second analog driving voltage) based on the first driving voltage DV1. The first source driver 322 may provide the first data voltage Vd1 to the first data lines DL1 in the display panel 310. The pixels coupled to the first data lines DL1 may receive the first data voltage Vd1 having the first polarity (+). The second source driver 324 may generate the second data voltage Vd2 having the second polarity (−) (e.g., a voltage having the voltage level between the second analog driving voltage and the ground voltage) based on the second driving voltage DV2. The second source driver 324 may provide the second data voltage Vd2 to the second data lines DL2 in the display panel 310. The pixels coupled to the second data lines DL2 may receive the second data voltage Vd2 having the second polarity (−).

The voltage generator 330 may provide the second driving voltage DV2 to the first source driver 322 and provide the first driving voltage DV1 to the second source driver 324 in the (N+1)-th frame (N+1)TH FRAME. The first source driver 322 may generate the second data voltage Vd2 having the second polarity (−) (e.g., a voltage having the voltage level between the second analog driving voltage and the ground voltage) based on the second driving voltage DV2. The first source driver 322 may provide the second data voltage Vd2 to the first data lines DL1 in the display panel 310. The pixels coupled to the first data lines DL1 may receive the second data voltage Vd2 having the second polarity (−). The second source driver 324 may generate the first data voltage Vd1 having the first polarity (+) (e.g., a voltage having the voltage level between the first analog driving voltage and the second analog driving voltage) based on the first driving voltage DV1. The second source driver 324 may provide the first data voltage to the second data lines DL2 in the display panel 310. The pixels coupled to the second data lines DL2 may receive the first data voltage Vd1 having the first polarity (+).

Figure 7:
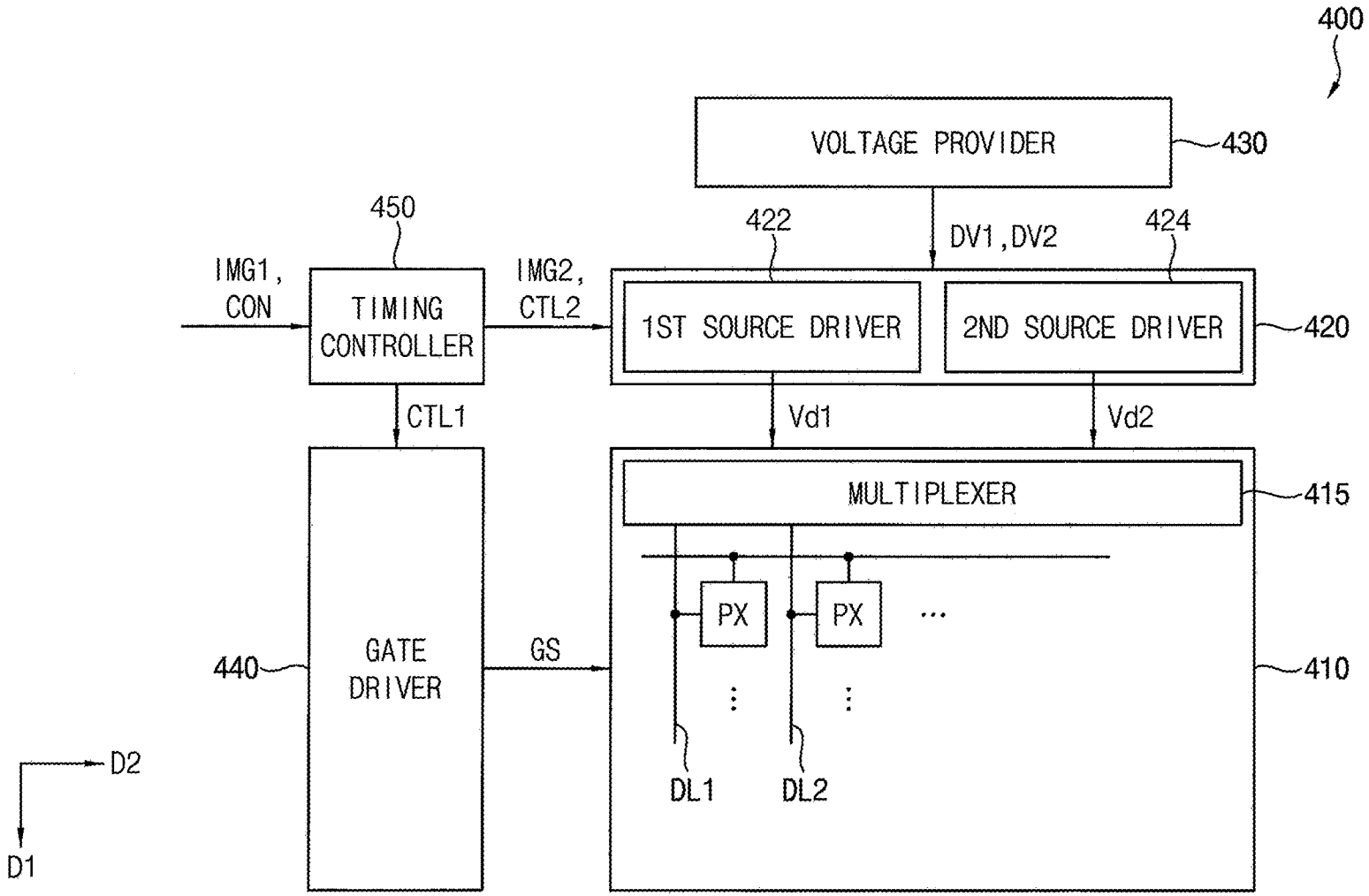
FIG. 7 is a block diagram illustrating a display device according to an alternative exemplary embodiment.

FIG. 7 is a block diagram illustrating a display device according to an alternative exemplary embodiment.

Referring to FIG. 7, an exemplary embodiment of a display device 400 may include a display panel 410, a voltage generator 430, and a source driver 420. Further, the display device 400 may include a gate driver 440 and a timing controller 450.

The display panel 410 may include first data lines DL1, second data lines DL2, gate lines GL, a plurality of pixels PX, and a multiplexer 415. The first data lines DL1 and the second data lines DL2 may extend in a first direction D1 and be arranged in a second direction D2 perpendicular to the first direction D1. In one exemplary embodiment, for example, the first data lines DL1 and the second data lines DL2 may be alternately arranged with each other. The gate lines GL may extend in the second direction D2 and be arranged in the first direction D1. In one exemplary embodiment, for example, the first direction D1 may be parallel to a short side of the display panel 110, and the second direction D2 may be parallel to a long side of the display panel 110. In one exemplary embodiment, for example, each of the pixels PX may be defined in intersection regions of the first data lines DL1 and the gate lines GL and in intersection regions of the second data lines DL2 and the gate lines GL. In one exemplary embodiment, for example, the first data lines DL1 may be coupled to odd-numbered pixel groups including the pixels PX arranged in a line and the second data lines DL2 may be coupled to even-numbered pixel groups including the pixels PX arranged in the line. The multiplexer 415 may be coupled to the first data liens DL1 and the second data lines DL2.

The voltage generator 430 may generate a first driving voltage DV1 and a second driving voltage DV2. The first driving voltage DV1 may include a first analog driving voltage and a second analog driving voltage having a voltage level lower than that of the first analog driving voltage DV1. In one exemplary embodiment, for example, the voltage level of the second analog voltage may be a half of the first analog driving voltage. In one exemplary embodiment, for example, the voltage level of the first analog driving voltage is about 8 V, and the voltage level of the second analog driving voltage may be about 4 V. The second driving voltage DV2 may include the second analog driving voltage and a ground voltage. In one exemplary embodiment, for example, the ground voltage may be 0 V. The voltage generator 430 may provide the first driving voltage DV1 and the second driving voltage DV2 to the source driver 420.

The source driver 420 may include a first source driver 422 and a second source driver 424. The first source driver 422 may generate a first data voltage Vd1 having a first polarity based on the first driving voltage DV1. In one exemplary embodiment, for example, the first data voltage Vd1 having the first polarity may be a positive polarity voltage. The first data voltage Vd1 may have a voltage level changed between the first analog driving voltage and the second analog driving voltage. The first source driver 422 may be coupled to the multiplexer 415. The second source driver 424 may generate a second data voltage Vd2 having a second polarity based on the second driving voltage DV2. In one exemplary embodiment, for example, the second data voltage Vd2 having the second polarity may be a negative polarity voltage. The second data voltage Vd2 may have a voltage level changed between the second analog driving voltage and the ground voltage. The second source driver 424 may be coupled to the multiplexer 415.

In an exemplary embodiment, the multiplexer 415 may couple the first source driver 422 alternately to the first data lines DL1 and the second data liens DL2. The multiplexer 415 may couple the second source driver 424 alternately to the first data lines DL1 and the second data lines DL2. In such an embodiment, the multiplexer 415 may alternately output the first data voltage Vd1 and the second data voltage Vd2 to the first data lines DL1 and the second data lines DL2. The multiplexer 415 may selectively couple the first data lines DL1 to the first source driver 422 or the second source driver 424. The multiplexer 415 may selectively couple the second data lines DL2 to the first source driver 422 or the second source driver 424. In one exemplary embodiment, for example, the multiplexer 415 may couple the first data lines DL1 alternately to the first source driver 422 and the second source driver 424 and may couple the second data lines DL2 alternately to the first source driver 422 and the second source driver 424 on a frame-by-frame basis. In an exemplary embodiment, the multiplexer 415 may couple the first data lines DL1 to the first source driver 422, provide the first data voltage Vd1 to first data lines DL1, couple the second data lines DL2 to the second source driver 424, and provide the second data voltage Vd2 to the second data lines DL2 in an N-th frame, where N is an integer greater than 0. The multiplexer 415 may couple the first data lines DL1 to the second source driver 424, provide the second data voltage Vd2 to the first data lines DL1, couple the second data lines DL2 to the first source driver 422, and provide the first data voltage Vd1 to the second data lines DL2 in an (N+1)-th frame.

The gate driver 440 may generate a gate signal GS to be provided to the pixel PX. The gate driver 440 may generate the gate signal GS based on a first control signal CTL1 provided from the timing controller 450, and sequentially provide the gate signal GS to the gate lines GL in the display panel 410.

The timing controller 450 may generate control signals CTL1, CTL2 that control the gate driver 440 and the source driver 420. The timing controller 450 may receive a control signal CON from an external device. The timing controller 450 may generate the first control signal CTL1 to be provided to the gate driver 440 based on the control signal CON. The timing controller 450 may generate the second control signal CTL2 to be provided to the source driver 420 based on the control signal CON. In such an embodiment, the timing controller 450 may convert a first image data IMG1 provided from the external device to the second image data IMG2.

The second image data IMG2 may be provided to the first source driver 422 and the second source driver 424 as a logic signal. The logic signal may be provided to the first source driver 422 and the second source driver 424 from the timing controller 450 using an AC coupling. The voltage generator 430 may provide bias voltages for the AC coupling to each of the first source driver 422 and the second source driver 424. The voltage generator 430 may provide the bias voltage having a voltage level the same as the second analog driving voltage to the first source driver 422, to which the first driving voltage DV1 is provided, and provide the bias voltage having a voltage level the same as the ground voltage to the second source driver 424, to which the second driving voltage DV2 is provided.

In such an embodiment, as described above, the display device may decrease load of the first source driver 422 and the second source driver 424 by including the first source driver 422 that generates the first data voltage Vd1, the second source driver 424 that generates the second data voltage Vd2, and the multiplexer 415 that alternately couple the first source driver 422 and the second source driver 424 to the first data liens DL1 and the second data lines DL2. Thus, the heat problem of the first source driver 422 and the second source driver 424 may be effectively prevented.

Figure 8:
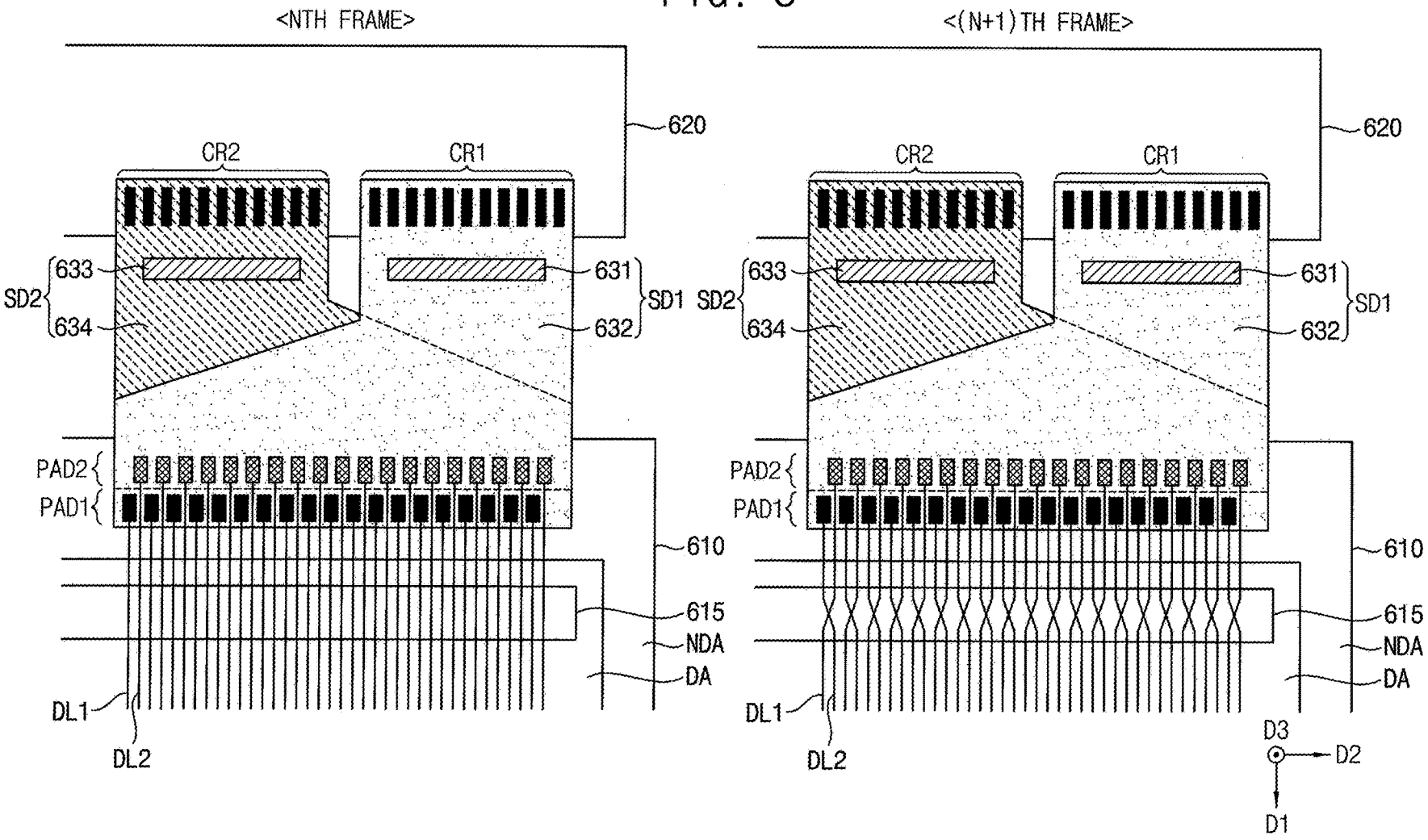
FIG. 8 is a diagram illustrating an operation of a multiplexer included in the display device of FIG. 7.

FIG. 8 is a diagram illustrating an operation of a multiplexer included in the display device of FIG. 7.

Referring to FIG. 8, the source driver may include the first source driver SD1 and the second source driver SD2. The first source driver SD1 and the second source driver SD2 may be implemented as a chip on film that includes the integrated circuit 631, 633 and the flexible printed circuit board 632, 634 on which the integrated circuit 631, 633 is mounted and be coupled to the display panel 610 and a printed circuit board.

The display panel 610 may include a display area DA and a non-display area NDA. The plurality of data lines DL1, DL2 may be formed in the display area. A pad unit PAD1, PAD2 coupled to the data liens DL1, DL2 may be formed in the non-display area NDA. Specifically, the pad unit PAD1, PAD2 may include a first pad unit PAD1 and a second pad unit PAD2. Pads of the first pad unit PAD1 may be arranged in the second direction D2 and pads of the second pad unit PAD2 may be arranged in the second direction D2. The first pad unit PAD1 may be parallel with the second pad unit PAD2 in the first direction D1. The first pad unit PAD1 and the second pad unit PAD2 may be coupled to the multiplexer 615.

The printed circuit board 620 may include the timing controller, the voltage generator, etc. implemented as the driving chip. In one exemplary embodiment, for example, the timing controller may generate the second image data and the second control signal and the voltage generator may generate the first driving voltage and the second driving voltage. The printed circuit board 620 may include a first connection region CR1 and a second connection region CR2. The first connection region CR1 may be coupled to the first source driver SD1 and the second connection region CR2 may be coupled to the second source driver SD2. The second image data, the second control signal, the first driving voltage, and the second driving voltage generated in the timing controller and in the voltage generator may be provided to the first source driver SD1 and the second source driver SD2 through the first connection region CR1 and the second connection region CR2 of the printed circuit board 620. Further, the first driving voltage may be provided to the first source driver SD1 through the first connection region CR1 and the second driving voltage may be provided to the second source driver SD2 through the second connection region CR2. Here, the voltage generator may be coupled to the first source driver SD1 and the second source driver SD2 through different layers or different lines of the printed circuit board 620. Thus, the voltage generator may provide different voltages (i.e., the first driving voltage and the second driving voltage) to the first source driver SD1 and the second source driver SD2.

The first source driver SD1 may include a first integrated circuit 631 and a first flexible printed circuit board 632. The first integrated circuit 631 may be mounted on the first flexible printed circuit board 632. The first flexible printed circuit board 632 of the first source driver SD1 may be coupled between the first connection region CR1 of the printed circuit board 620 and the first pad unit PAD1 of the display panel 610.

The second source driver SD2 may include a second integrated circuit 633 and a second flexible printed circuit board 634. The second integrated circuit 633 may be mounted on the second flexible printed circuit board 634. The second flexible printed circuit board 634 of the second source driver SD2 may be coupled between the second connection region CR2 of the printed circuit board 620 and the second pad unit PAD2 of the display panel 610.

The first flexible printed circuit board 632 of the first source driver SD1 and the second flexible printed circuit board 634 of the second source driver SD2 may partially overlap each other in a third direction D3 as described in FIG. 8. Here, a size of the second flexible printed circuit board 634 of the second source driver SD2 may be small than a size of the first flexible printed circuit board 632 of the first source driver SD1.

In an exemplary embodiment, the multiplexer 615 may couple the first pad unit PAD1 to the first data line DL1 or the second data line DL2. In such an embodiment, the multiplexer 615 may couple the second pad unit PAD2 to the first data line DL1 or the second data line DL2. In one exemplary embodiment, for example, the multiplexer 615 may couple the first pad unit PAD1 alternately to the first data line DL1 and the second data line DL2, and couple the second pad unit PAD2 alternately to the first data line DL1 and the second data line DL2 on a frame-by-frame basis. In such an embodiment, as shown in FIG. 8, the multiplexer 615 may couple the first pad unit PAD1 to the first data line DL1, and the second pad unit PAD2 to the second data line DL2 in an N-th frame NTH FRAME. Thus, the first data voltage having the first polarity generated in the first source driver SD1 may be provided to the first data line DL1 and the second data voltage having the second polarity generated in the second source driver SD2 may be provided to the second data line DL2. The multiplexer 615 may couple the first pad unit PAD1 and the second data line DL2, and second pad unit PAD2 to the first data line DL1 in an (N+1)-th frame (N+1)TH FRAME. Thus, the second data voltage having the second polarity generated in the second source driver SD2 may be provided to the first data line DL1 and the first data voltage having the first polarity generated in the first source driver SD1 may be provided to the second data line DL2.

In an exemplary embodiment, as described above, the display device may decrease the loads of the first source driver SD1 and the second source driver SD2 by including the first source driver SD1 that generates the first data voltage having the first polarity, the second source driver SD2 that generates the second data voltage having the second polarity, and the multiplexer 615 that couples the first source driver SD1 alternately to the first data lines DL1 and the second data lines DL2 and couples the second source driver SD2 alternately to the first data lines DL1 and the second data lines DL2. Thus, the heat generated from the first source driver SD1 and the second source driver SD2 may decrease.

Figure 9:
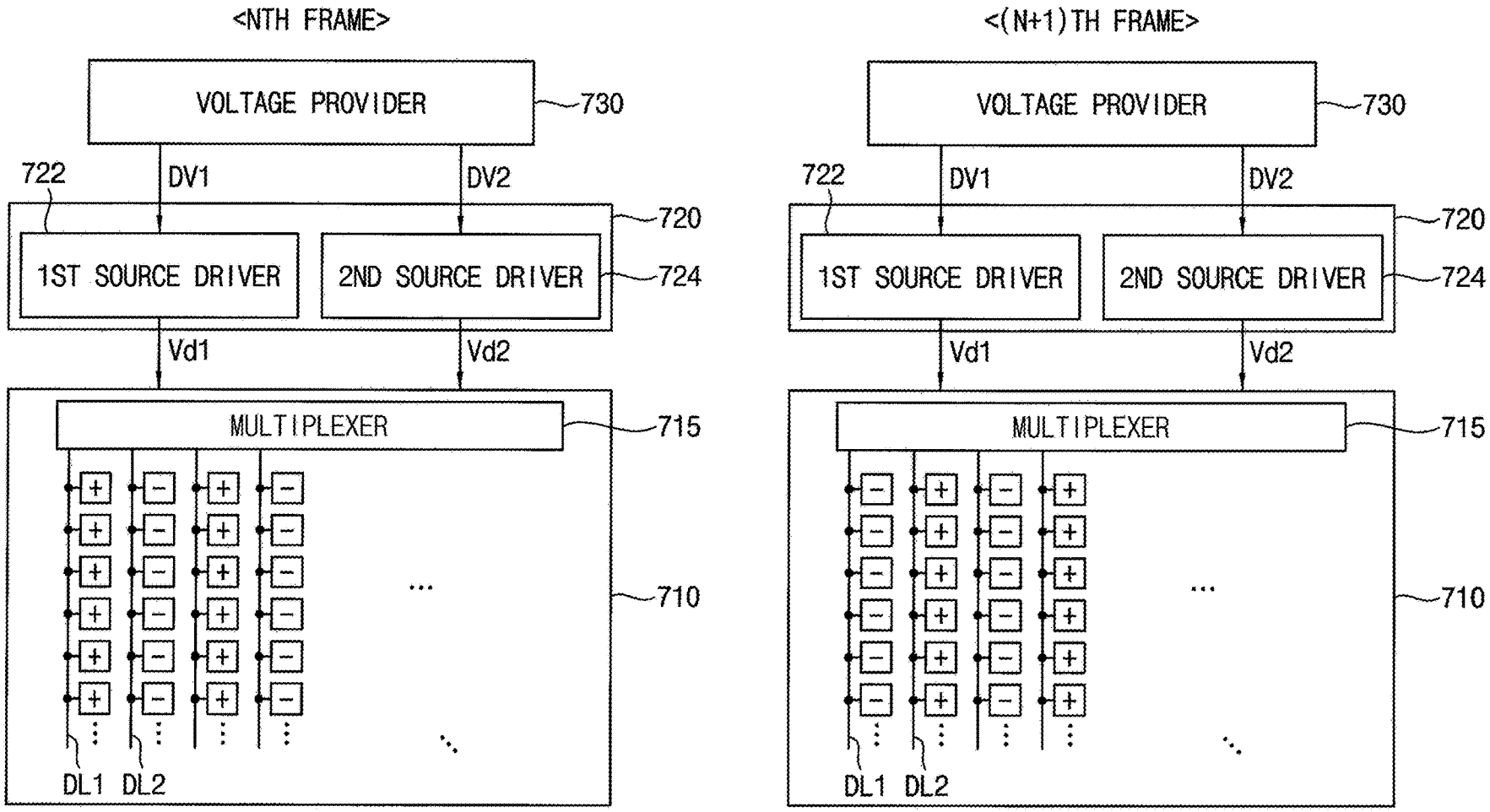
FIG. 9 is a diagram illustrating an operation of the display device of FIG. 7.

FIG. 9 is a diagram illustrating an operation of the display device of FIG. 7.

Referring to FIG. 9, the voltage generator 730 may provide the first driving voltage DV1 to the first source driver 722 of the source driver 720 and the second driving voltage DV2 to the second source driver 724 of the source driver 720 in the N-th frame NTH FRAME. The first source driver 722 may generate the first data voltage Vd1 having the first polarity (+) (e.g., a voltage having the voltage level between the first analog driving voltage and the second analog driving voltage) based on the first driving voltage DV1. The second source driver 324 may generate the second data voltage Vd2 having the second polarity (−) (e.g., a voltage having the voltage level between the second analog driving voltage and the ground voltage) based on the second driving voltage DV2. The multiplexer 715 formed in the display panel 710 may couple the first source driver 722 to the first data lines DL1, and couple the second source driver 724 to the second data lines DL2. Thus, the pixels coupled to the first data lines DL1 may receive the first data voltage Vd1 having the first polarity (+) and the pixels coupled to the second data lines DL2 may receive the second data voltage Vd2 having the second polarity (−).

The voltage generator 730 may provide the first driving voltage DV1 to the first source driver 722 and the second driving voltage DV2 to the second source driver 724 in the (N+1)-th frame (N+1)TH FRAME. The first source driver 722 may generate the first data voltage Vd1 having the first polarity (+) (e.g., a voltage having the voltage level between the first analog driving voltage and the second analog driving voltage) based on the first driving voltage DV1. The second source driver 324 may generate the second data voltage Vd2 having the second polarity (−) (e.g., a voltage having the voltage level between the second analog driving voltage and the ground voltage) based on the second driving voltage DV2. The multiplexer 715 in the display panel 710 may couple the first source driver 722 to the second data lines DL2, and couple the second source driver 724 to the first data lines DL1. Thus, the pixels coupled to the first data lines DL1 may receive the second data voltage Vd2 having the second polarity (−) and the pixels coupled to the first data lines DL1 may receive the first data voltage Vd1 having the first polarity (+).

Exemplary embodiments of the invention may be applied to a display device and an electronic device including the display device, for example a computer monitor, a laptop, a digital camera, a cellular phone, a smart phone, a smart pad, a television, a personal digital assistant ("PDA"), a portable multimedia player ("PMP"), a MP3 player, a navigation system, a game console, a video phone, etc.

The invention should not be construed as being limited to the exemplary embodiments set forth herein. Rather, these exemplary embodiments are provided so that this disclosure will be thorough and complete and will fully convey the concept of the invention to those skilled in the art.

While the invention has been particularly shown and described with reference to exemplary embodiments thereof, it will be understood by those of ordinary skill in the art that various changes in form and details may be made therein without departing from the spirit or scope of the invention as defined by the following claims.

What is claimed is:

1. A display device comprising:

a display panel including first data lines, second data lines, gate lines, and a plurality of pixels;

a voltage generator which generates a first driving voltage and a second driving voltage, the first driving voltage including only a first analog driving voltage and a second analog driving voltage having a same voltage level each frame lower than a same voltage level each frame of the first analog driving voltage, the second driving voltage including only the second analog driving voltage and a ground voltage, and the first driving voltage having a same nonvariable maximum voltage level each frame while the second driving voltage has a same nonvariable minimum voltage level each frame, the ground voltage having a voltage level different from the voltage levels of the first analog driving voltage and the second analog driving voltage; and a source driver which generates a first data voltage having a first polarity based on the first driving voltage and a second data voltage having a second polarity based on the second driving voltage, wherein the source driver includes a first source driver coupled to the first data lines and a second source driver coupled to the second data lines, wherein the voltage generator alternately provides the first driving voltage and the second driving voltage to each of the first source driver and the second source driver independent of any display data, wherein the first source driver provides the first data voltage having the first polarity to the first data lines when the second source driver provides the second data voltage having the second polarity to the second data lines in an N-th frame, wherein N is an integer greater than zero, and wherein the first source driver provides the second data voltage having the second polarity to the first data lines when the second source driver provides the first data voltage having the first polarity to the second data lines in an (N+1)-th frame.

2. The display device of claim 1, wherein the voltage generator provides the first driving voltage to the first source driver and provides the second driving voltage to the second source driver in the N-th frame, and the voltage generator provides the second driving voltage to the first source driver and provides the first driving voltage to the second source driver in the (N+1)-th frame.

3. The display device of claim 2, wherein the first source driver generates the first data voltage having the first polarity based on the first driving voltage and the second source driver generates the second data voltage having the second polarity based on the second driving voltage in the N-th frame, and the first source driver generates the second data voltage having the second polarity based on the second driving voltage and the second source driver generates the first data voltage having the first polarity based on the first driving voltage in the (N+1)-th frame.

4. The display device of claim 1, wherein the first data voltage has a voltage level changed between the voltage level of the first analog driving voltage and the voltage level of the second analog voltage, and wherein the second data voltage has a voltage level changed between the voltage level of the second analog driving voltage and the ground voltage.

5. The display device of claim 1, wherein when the voltage generator provides the first driving voltage, the voltage generator further provides a bias voltage having a voltage level the same as the voltage level of the second analog driving voltage to provide a logic signal, and when the voltage generator provides the second driving voltage, the voltage generator further provides a bias voltage having a voltage level the same as the voltage level of the ground voltage to provide the logic signal.

6. The display device of claim 1, wherein the first data lines are coupled to an odd-numbered pixel groups including pixels arranged in a line, and the second data lines are coupled to an even-numbered pixel groups including pixels arranged in a line.

7. The display device of claim 1, wherein each of the first and second source drivers is implemented as a chip-on-film form including an integrated circuit and a flexible printed circuit board, on which the integrated circuit is disposed.

* * * * *